United States Patent [19]

Brinkmann

[11] 4,098,319

[45] Jul. 4, 1978

[54] CONTINUOUS CASTING AND SIZING APPARATUS, AND METHOD THEREOF

[75] Inventor: Joseph Bernard Brinkmann, Oxford, Conn.

[73] Assignee: General Electric Company, New York, N.Y.

[21] Appl. No.: 528,637

[22] Filed: Dec. 2, 1974

[51] Int. Cl.[2] ..... B22D 11/00; B05C 3/12; B05D 7/20

[52] U.S. Cl. ..... 164/86; 118/118; 164/419; 164/448; 427/360; 427/434 E

[58] Field of Search ..... 164/277, 282, 275, 86, 164/82, 419, 442, 448, 424; 75/126 C, 126 E; 427/434 D, 434 E, 436, 360, 367; 118/101, 118, 123

[56] References Cited

U.S. PATENT DOCUMENTS 3,235,960 2/1966 Carreker, Jr. ..... 164/86 X

OTHER PUBLICATIONS

Metal Progress Databook, ASM, 1970, pp. 130–135.
Metals Handbook, vol. 1, 1961, pp. 638–640, 646–647.

*Primary Examiner*—Francis S. Husar
*Assistant Examiner*—Gus T. Hampilos
*Attorney, Agent, or Firm*—R. G. Simkins; P. L. Schlamp

[57] ABSTRACT

Apparatus for a process of continuously casting and sizing metals by passing a metal core member through a container of molten metal to accrete and solidify the molten metal thereon, and passing the cast product through a series of pairs of counterpoised sizing rolls composed of a specific steel composition to consolidate and smooth the cast product; and a method of continuously casting and sizing metals.

8 Claims, 1 Drawing Figure

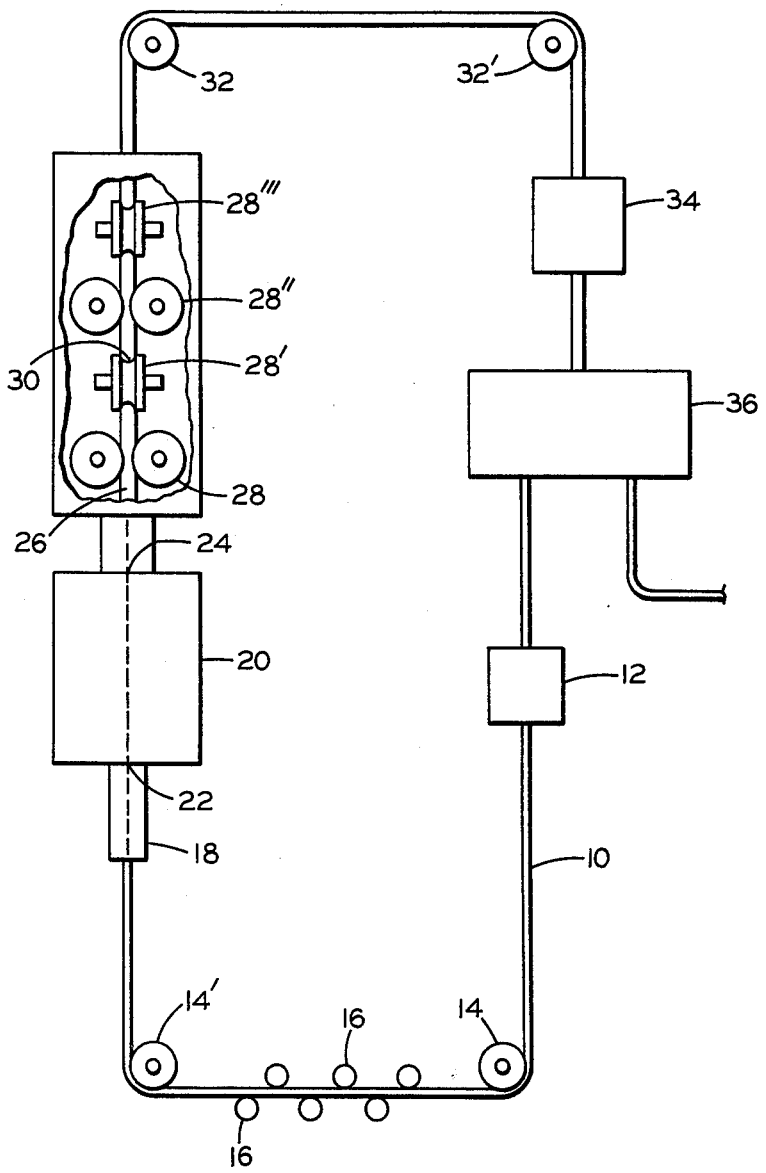
32
32′
28‴
34
28″
30
28′
36
28
26
24
20
12
22
18
10
14′
16
14
16

CONTINUOUS CASTING AND SIZING APPARATUS, AND METHOD THEREOF

BACKGROUND OF THE INVENTION

This invention relates to an improvement in apparatus and method for continuous metal casting and sizing, or the so-called "dip forming process" of metal casting. The apparatus includes a crucible or refractory container for molten metal and means for the passage of a core member through the molten metal contents thereof, combined with a series of counterpoised pairs of sizing rolls. The sizing rolls consolidate the molten metal which accretes and solidifies on the core member and smooths the surface of the composite cast product.

The dip forming process of continuously casting by means of passing a core member through a crucible of molten metal and consolidating and smoothing the cast product, and apparatus therefore, is the subject of may prior U.S. patents, including:

| | | |
|---|---|---|
| 3,008,201 | 3,235,960 | 3,598,085 |
| 3,060,053 | 3,424,130 | 3,160,204 |
| 3,060,054 | 3,466,186 | 3,109,722 |
| 3,060,055 | 3,484,280 | 3,813,260 |
| 3,060,056 | 3,510,345 | |
| 3,094,752 | 3,538,884 | |

The disclosures of these U.S. patents are incorporated herein by reference.

An important aspect in the production by the dip forming procedure of sound cast products having an integrated structure therethrough, is the "sizing" of the formed composite of the core member carrying thereon a coating of accreted and solidifying molten metal following emergence of the formed composite from the melt. In addition to reducing the irregularly cast material to a uniform diameter, the sizing operation comprises consolidating the core and the plastic coating thereon under pressure to forge and infuse the coating of accreted and solidifying metal with the core and to smooth the surface of the cast product. Uniformity of size and the integration of the coating-like body of cast metal with the core substrate are highly critical prerequisites when the cast product is thereafter employed in the drawing of relatively fine diameter wires and similar drawn products.

Being a continuous procedure, the sizing operation of the dip forming process is most expediently carried out with a rolling mill type of apparatus comprising a series of pairs of counterpoised rolls such as illustrated in U.S. Pat. No. 3,339,393. Preferably each pair of rolls for the compression therebetween of the stock, is combined with a second pair having their axis arranged at about a 90° angle so as to compress the stock equally thereabout, and a typical system comprises four pairs of counter-poised mill rolls aligned in sequence for the progressive passage of stock between and through each pair and arranged with alternate pairs having their axis at about a 90° angle to the axis of each adjacent pair. However, the number of pairs of sizing rolls in sequence can be varied according to conditions such as the extent of cross-section reduction of the cast product and its degree of hardness, or the shape to be imparted thereto.

Also, the surface of the sizing or mill rolls are typically contoured to impart the shape of the desired product into the cast material, such as the concave eliptical or semicircular grooves in the roll faces shown in U.S. Pat. No. 3,339,393 for the rolling of rod-like stock having a generally round cross sectional configuration.

A significant defect insofar as product quality and operating costs in the dip forming process of continuously casting as heretofore practiced and provided for by prior art apparatus, is the rapid deterioration of the mill roll surfaces and the transfer or impression of the therein occurring surface irregularities from the rolls to the product passing therethrough. For example, heat checks or crazing have been observed to have developed on conventional sizing roll surfaces and have been transferred or imprinted on the product within 2 weeks from the time of installation of new rolls, and normally this impediment develops within about one or two months of roll service. The occurrence of the surface imperfections results in a substandard product, or causes the frequent and costly replacement of the deteriorating rolls.

SUMMARY OF THE INVENTION

This invention comprises an improvement in the apparatus and method for carrying out a continuous metal casting or dip forming and sizing process comprising passing a core member through a crucible or chamber containing molten metal and sizing the cast product between new and improved mill rolls, which substantially eliminates the development of surface deterioration and imperfections on the sizing rolls and the resultant degradation of the sized product, or the necessity of a high frequency of down time and roll replacement.

The improvement of this invention includes providing mill rolls for the sizing of the cast product composed of a hardened steel consisting essentially of iron, tungsten, molybdenum, chromium, vanadium and carbon.

OBJECTS OF THE INVENTION

A primary object of this invention is to provide an apparatus for continuously casting metal which effectively overcomes the degrading of the product, or the need for frequent replacement of equipment.

Another object of this invention is to extend production runs in continuous casting operations without impairing product quality, and to reduce downtime for replacement of parts by providing apparatus including steel mill rolls which are especially effective in resisting deterioration and heat checking or crazing.

A further object of this invention is to provide a method effective for the production of high quality, smooth surfaced, continuously cast products which are more amenable to metal working or shaping procedures such as wire drawing, and apparatus for carrying out the method.

An additional object of this invention is to provide an improved method of continuously casting metal which produces a smooth surfaced and flawless cast product.

BRIEF DESCRIPTION OF THE DRAWING

The drawing is a schematic illustration of the dip forming system and apparatus embodying the present invention and with parts broken away to show the sizing mill rolls thereof.

DETAILED DESCRIPTION OF A PREFERRED EMBODIMENT

Referring to the drawing, an extensive length of metal rod 10, such as copper or a copper-containing alloy, for the core member is supplied from a stock storage 12 and continuously moved through the dip forming system and apparatus as follows. Rod 10 is moved via conveyor and guide means, such as rolls 14 and 14' into the dip forming casting unit. Prior to its introduction into the casting unit, the rod 10 may be moved through any one or several possible treating means and steps, comprising, for example, straightening rolls 16, illustrated in the drawing, or surface cleaning means of several various types such as disclosed in the prior art patents identified above.

Rod 10 enters the dip forming casting unit through a vacuum vestibule chamber 18 enclosing the entry port to a crucible 20 containing the molten metal for the casting such as copper or a copper-containing alloy or metal. Preferably the crucible entry port 22 is located below the surface of the body of molten metal contained in the crucible, such as in the crucible bottom wall, and the crucible outlet port 24 is located above the molten metal, such as in the crucible top wall, whereby the rod comprising the casting core member moving through the system passes upward through the crucible and its molten metal contents. As the cooler core member rod 10 moves through the hot melt contents of the crucible contents, the molten metal adjacent to the core member is cooled and thereby adheres to the core member by solidification to effect the casting. The progressive adherence and accretion of the metal on the core and its solidification may extend the size of the cast product thereof up to twice or more the cross-sectional area of the initial core rod. However, as should be apparent the amount of melt cast about the core member, and in turn the diameter of the product thereof, depends upon several factors including the mass and diameter of the core rod, the relative temperatures of the melt and core rod, the depth of the body of the melt and the rate of travel of the core rod through the melt. Accordingly, the diameter of the cast product can vary considerably.

Upon emerging from the molten metal and a brief cooling, to at least partially solidify the cast metal accreted on the core member, the continuously cast product 26 is subjected to a sizing operation to reduce the product to a uniform cross-sectional dimension or diameter, consolidate or forge the cast and core components of the product into an integrated matrix by infusing the plastic or semisolid accreted coating of the cast melt phase into the underlying core phase, and smooth the surface of the product. The sizing operation is effected by passing the cast product 26 between a series of pairs of counterpoised mill rolls 28 wherein the cast product is compressed progressively to consolidate and reduce it, and smooth the surface thereof.

The mill rolls 28 are preferably provided with a concave recess or groove 30 of a configuration which is a counterpart of the configuration to be impressed upon the cast product 26, such as a semicircular groove 30 to mold cylindrical products. Also, to provide uniformity of sizing completely around the rod-like product, the pairs of counterpoised rolls should be arranged along the path of travel of the cast product with the axis of the alternating pairs of rolls 28 aligned about 90° to each other as shown.

In accordance with this invention, the mill rolls 28, or at least the working surface portions thereof, for the sizing of the hot cast product 26 are composed of, or formed from, a steel consisting essentially of the approximate composition, in percent by weight, of:

| | |
|---|---|
| Iron | 77.00 – 86.00 |

-continued

| | |
|---|---|
| Tungsten | 5.00 – 7.50 |
| Molybdenum | 3.75 – 6.25 |
| Chromium | 3.50 – 4.50 |
| Vanadium | 1.00 – 3.00 |
| Carbon | 0.80 – 0.90 |

which has been hardened to at least about 63 on the Rockwell "C" scale.

It has been discovered that sizing mill rolls, or the working surface portions thereof, composed of the aforesaid hardened steel compositions, effectively resist the development or occurrence of the heretofore soon encountered surface heat checks and/or crazing which generally occur when working very hot metals such as copper at about 1400° to about 1700° F, for long periods of such service. For instance, sizing mill rolls composed of the hardened steel composition of this invention have been found to provide exceptionally longer working periods free of the impairing heat checks and/or crazes that degrade the cast products and which extends their working service up to several times longer than prior rolls composed of other steel compositions.

On passing through the series of pairs of sizing mills rolls 28, 28', 28'' and 28''', the reduced, consolidated and smoothed cast product 26 is further cooled and conveyed, such as via guide rolls 32 and 32', to a suitable receiving means such as reeling means 34 for coiling the continuously formed and moving cast rod product moving through the system. The coiled product can be employed or sold as is, or the cast product 26 can be passed through a conventional reducing apparatus 36, or reduced to a suitable size rod 10 for use as core member stock whereby it can be retained in storage 12 until recycled through the system as a core member. Such recycling can be repeated innumerable times. Alternatively, the cast product 26 can be drawn into a variety of rod or wire products of many dimensions and/or cross sectional configuration, including very fine wires of down to as small as about 0.0007 of an inch.

A primary use of dip formed copper rod products is stock for drawing into very fine wires, and for specialty wires for certain critical applications or service such as motor or magnet windings. To provide the very high level of extensibility to be acceptable for such uses, the cast metal products must be uniformly reduced in size and consolidated to integrate the outer cast layer or phase with the core substrate, or phase, or with a plurality of previously cast similar underlying layers and the substrate core when the material has been repeatedly recycled through the process as is common, to a metallurgically homogeneous structure including composition, grain and consolidation, and the surface thereof smoothed free of irregularities.

Thus, the rapid deterioration of the sizing mill rolls within relative short periods of such service, and their accompanying progressive impairment of the product quality, necessarily results in either the production of inferior grade cast products, or the frequent and costly replacement of the mill rolls.

One procedure for hardening of the steel of this invention to a Rockwell "C" scale of about 63 to about 66 for the desired strength, stability and toughness, comprises the following. The steel rolls of the composition of this invention are preheated and austenitized in a protective atmosphere which does not affect their chemical composition by slowly bringing their temperature up to about 1525° to about 1550° F, and holding at this temperature level for about 30 to about 40 minutes. The thus preheated rolls are immediately transferred to a furnace maintained at about 2225° to about 2250° F and austenitized by holding at that temperature level for about 6 to 10 minutes. The thus heat treated rolls are then quenched in salt or oil held at about 150° to about 200° F, and when the temperature of the rolls has been reduced to a range of between 150° to 200° F, they are placed in a tempering furnace maintained at about 1075° ± 25° F and held there for about 4 hours. Promptly upon removal from the tempering furnace, the steel rolls are cooled to below 150° F minus zero degrees Fahrenheit and held for a minimum of about 10 minutes after the temperature is equalized through the mass of the rolls. Immediately after this stabilizing cooling treatment, the rolls are tempered again at about 25° F cooler than the first tempering temperature and held at this lower temperature level for at least about 3 hours. This treatment will produce a hardness of about 64 to about 65 Rockwell "C" scale with the steel composition of this invention.

An example demonstrating the practice of this invention, and its advantages and improvements over the prior art practices is provided by the following tests carried out under actual factory production conditions. The sizing mill rolls traditionally used for some years in routine dip forming factory production of copper rod were composed of a steel consisting essentially of a composition, in approximate percentages by weight, of: Iron — 92.15; Chromium — 5.0; Molybdenum — 1.5, Vanadium — 1.0; and Carbon — 0.35. Sizing mill rolls of this composition were observed in routine continuous manufacture of copper rod and found to perform on an average of about one to two months of constant service before heat checking and crazing so deteriorated their surface as to require their replacement to prevent the formation of low grade cast rod products unsuitable for premium service. Moreover, this deleterious condition was observed to have developed as soon as only two weeks service in one instance and thereby requiring installation of new rolls.

Sizing mill rolls of the same dimensions and configurations as those formerly used were made composed of a steel consisting essentially of the approximate composition, in percent by weight, of: Iron — 81.90; Tungsten — 6.25; Molybdenum — 5.00; Chromium — 4.00; Vanadium — 2.00; and Carbon — 0.85, hardened to the Rockwell "C" scale of about 65 by the above given process. A set of the sizing mill rolls of this composition were installed in the dip forming apparatus for testing of their endurance and thus used in the manufacture of dip formed copper rod under identical production condition as before. These sizing mill rolls haven been tested while undergoing routine constant service for eight months and as yet show no discernable evidence of heat checks or crazing, or other deterioration, and continue to produce top quality cast copper rod which is satisfactory for the most demanding of uses.

I claim:

1. A method of continuously casting and sizing metals comprising copper comprising the steps of: passing a core member of a metal comprising copper into and through a crucible containing molten metal comprising copper and thereby accreting and solidifying molten metal comprising copper on the core member of a metal comprising copper producing a cast product, and passing the cast product through a series of pairs of counterpoised sizing rolls having working surfaces composed of a steel consisting essentially of the approximate composition, in percent by weight, of:

| | |
|---|---|
| Iron | 77.00 - 86.00 |
| Tungsten | 5.00 - 7.50 |
| Molybdenum | 3.75 - 6.25 |
| Chromium | 3.50 - 4.50 |
| Vanadium | 1.00 - 3.00 |
| Carbon | 0.80 - 0.90 |

hardened to at least about 63 on the Rockwell "C" scale, to consolidate and smooth the surface of the cast product.

2. The method of claim 1, wherein the working surfaces of the pairs of counterpoised sizing rolls are composed of a steel consisting essentially of the approximate composition, in percent by weight, of:

| | |
|---|---|
| Iron | 81.90 |
| Tungsten | 6.25 |
| Molybdenum | 5.00 |
| Chromium | 4.00 |
| Vanadium | 2.00 |
| Carbon | 0.85 |

hardened to at least about 63 on the Rockwell "C" scale.

3. A method of continuously casting and sizing copper comprising the steps of: passing a copper core member into and through a crucible containing molten copper and thereby accreting and solidifying molten copper on the core member producing a cast product, and passing the cast product through a series of pairs of counterpoised sizing rolls composed of a steel consisting essentially of the approximate composition in percent by weight of:

| | |
|---|---|
| Iron | 77.00 - 86.00 |
| Tungsten | 5.00 - 7.50 |
| Molybdenum | 3.75 - 6.25 |
| Chromium | 3.50 - 4.50 |
| Vanadium | 1.00 - 3.00 |
| Carbon | 0.80 - 0.90 |

hardened to about 63 to about 66 on the Rockwell "C" scale, to consolidate and smooth the surface of the cast product.

4. The method of claim 3, wherein the pairs of counterpoised sizing rolls are composed of a steel consisting essentially of the approximate composition, in percent by weight, of:

| | |
|---|---|
| Iron | 81.90 |
| Tungsten | 6.25 |
| Molybdenum | 5.00 |
| Chromium | 4.00 |
| Vanadium | 2.00 |
| Carbon | 0.85 |

hardened to at least about 63 to about 65 on the Rockwell "C" scale.

5. Apparatus for the continuous casting and sizing of metals comprising copper by passing a core member of metal comprising copper through a crucible containing molten metal comprising copper to accrete and solidify molten metal on the core member and rolling the cast product to consolidate the cast metal on the core member and smooth its surface, comprising the combination of: a crucible for the containment of molten metal comprising copper having means for the passage of a core member of metal comprising copper through its molten metal contents, and multiple pairs of counterpoised sizing rolls arranged to receive a cast product emerging from the crucible for the consolidation and smoothing of the cast product, said sizing rolls having working surfaces composed of a steel consisting essentially of the approximate composition, in percent by weight, of:

| | | |
|---|---|---|
| Iron | [92.70 - 83.85] | 77.00 - 86.00 |
| Tungsten | [2.00 - 6.00] | 5.00 - 7.50 |
| Molybdenum | | 3.75 - 6.25 |
| Chromium | | 3.50 - 4.50 |
| Vanadium | | 1.00 - 3.00 |
| Carbon | | 0.80 - 0.90 |

hardened to at least about 63 on the Rockwell "C" scale.

6. The apparatus of claim 1, wherein the working surfaces of the sizing rolls are composed of a steel consisting essentially of the approximate composition, in percent by weight, of:

| | |
|---|---|
| Iron | 81.90 |
| Tungsten | 6.25 |
| Molybdenum | 5.00 |
| Chromium | 4.00 |
| Vanadium | 2.00 |
| Carbon | 0.85 |

hardened to at least about 63 on the Rockwell "C" scale.

7. Apparatus for the continuous casting and sizing of copper by passing a copper core member through a crucible containing molten copper to accrete and solidify molten copper on the core member and rolling the cast product to consolidate the cast copper on the core member and smooth its surface, comprising the combination of: a crucible for the containment of molten copper having an entry port and an exit port for the passage of a copper core member through the crucible and molten copper contents thereof, and at least two pairs of counterpoised sizing rolls arranged to receive a cast product emerging from the crucible exit port for the consolidation and smoothing of the cast product, said sizing rolls being composed of a steel consisting essentially of the approximate composition, in percent by weight, of:

| | | |
|---|---|---|
| Iron | [92.70 - 83.85] | 77.00 - 86.00 |
| Tungsten | [2.00 - 6.00] | 5.00 - 7.50 |
| Molybdenum | | 3.75 - 6.25 |
| Chromium | | 3.50 - 4.50 |
| Vanadium | | 1.00 - 3.00 |
| Carbon | | 0.80 - 0.90 |

hardened to about 63 to about 66 on the Rockwell "C" scale.

8. The apparatus of claim 7, wherein the sizing rolls are composed of a steel consisting essentially of the approximate composition, in percent by weight, of:

| | |
|---|---|
| Iron | 81.90 |
| Tungsten | 6.25 |
| Molybdenum | 5.00 |
| Chromium | 4.00 |
| Vanadium | 2.00 |
| Carbon | 0.85 |

hardened to about 63 to about 66 on the Rockwell "C" scale.

* * * * *

UNITED STATES PATENT AND TRADEMARK OFFICE

CERTIFICATE OF CORRECTION

PATENT NO. : 4,098,319

DATED : July 4, 1978

INVENTOR(S) : Joseph Bernard Brinkmann

It is certified that error appears in the above-identified patent and that said Letters Patent are hereby corrected as shown below:

In each of Claims 5 and 7, in the table, the part reading

| | | |
|---|---|---|
| "Iron | [92.70 - 83.85] | 77.00 - 86.00" |
| "Tungsten | [2.00 - 6.00] | 5.00 - 7.50" |

should read:

| | |
|---|---|
| Iron | 77.00 - 86.00 |
| Tungsten | 5.00 - 7.50 |

Claim 6, line 1, "claim 1" should read --claim 5--.

Signed and Sealed this

*Twenty-sixth* Day of *February 1980*

[SEAL]

*Attest:*

SIDNEY A. DIAMOND

*Attesting Officer*

*Commissioner of Patents and Trademarks*